US010650951B2

(12) United States Patent
Sakai et al.

(10) Patent No.: US 10,650,951 B2
(45) Date of Patent: May 12, 2020

(54) MAGNETIC ELEMENT

(71) Applicant: NTN CORPORATION, Osaka (JP)

(72) Inventors: Kayo Sakai, Aichi (JP); Eiichirou Shimazu, Aichi (JP); Shougo Kanbe, Aichi (JP); Takayuki Oda, Aichi (JP)

(73) Assignee: NTN CORPORATION, Osaka (JP)

( * ) Notice: Subject to any disclaimer, the term of this patent is extended or adjusted under 35 U.S.C. 154(b) by 151 days.

(21) Appl. No.: 15/578,194

(22) PCT Filed: May 25, 2016

(86) PCT No.: PCT/JP2016/065403
§ 371 (c)(1),
(2) Date: Nov. 29, 2017

(87) PCT Pub. No.: WO2016/194723
PCT Pub. Date: Dec. 8, 2016

(65) Prior Publication Data

US 2018/0151284 A1 May 31, 2018

(30) Foreign Application Priority Data

May 29, 2015 (JP) ..... 2015-109822
Feb. 24, 2016 (JP) ..... 2016-033563

(51) Int. Cl.
*H01F 27/08* (2006.01)
*H01F 17/04* (2006.01)
(Continued)

(52) U.S. Cl.
CPC ..... *H01F 17/04* (2013.01); *B22F 3/225* (2013.01); *H01F 3/10* (2013.01); *H01F 17/043* (2013.01);
(Continued)

(58) Field of Classification Search
CPC ..... H01F 27/00–36
(Continued)

(56) References Cited

U.S. PATENT DOCUMENTS 3,253,241 A * 5/1966 Tippett ..... H01F 17/043 336/137
3,609,615 A * 9/1971 Parker ..... H01F 17/043 336/178
(Continued)

FOREIGN PATENT DOCUMENTS

CN 1941227 A 4/2007
CN 104488042 A 4/2015
(Continued)

OTHER PUBLICATIONS

International Search Report for PCT/JP2016/065403 dated Aug. 9, 2016.
(Continued)

*Primary Examiner* — Tuyen T Nguyen
(74) *Attorney, Agent, or Firm* — Hedman & Costigan, P.C.; James V. Costigan; Kathleen A. Costigan

(57) ABSTRACT

To provide a magnetic element such as a pot-shaped inductor in which a coil is covered by a magnetic body, having excellent cooling performance and being capable of suppressing heat generation. An inductor 1 as the magnetic element is provided with a coil formed by winding a winding wire, a magnetic body 2 in which the coil 5 is arranged and which transmits magnetic flux generated by the coil 5. The magnetic body 2 includes an air-cooling portion for air-cooling the magnetic element, on a magnetic body outer diameter portion which covers an outer diameter side of the coil 5. The air cooling portion is formed of a slit 7 as a hole structure penetrating the magnetic body outer diameter portion. Further, in a configuration in which the coil is sealed by a sealing resin, the magnetic body includes a flow control
(Continued)

path, which controls a flow of the resin in filling the sealing resin, on a surface facing the coil.

9 Claims, 12 Drawing Sheets

(51) Int. Cl.

| | |
|---|---|
| ***H01F 3/10*** | (2006.01) |
| ***H01F 27/24*** | (2006.01) |
| ***B22F 3/22*** | (2006.01) |
| ***H01F 27/28*** | (2006.01) |
| *H01F 3/08* | (2006.01) |

(52) U.S. Cl.
CPC ..... *H01F 27/08* (2013.01); *H01F 27/085* (2013.01); *H01F 27/24* (2013.01); *H01F 27/2823* (2013.01); *H01F 3/08* (2013.01); *H01F 2003/106* (2013.01)

(58) Field of Classification Search
USPC ..... 336/65, 83, 90, 92, 96, 178, 210–215, 336/233–234
See application file for complete search history.

(56) References Cited

U.S. PATENT DOCUMENTS

| | | | | | |
|---|---|---|---|---|---|
| 4,004,251 | A * | 1/1977 | Hesler | H01F 19/08 | 331/113 A |
| 4,117,436 | A * | 9/1978 | MacLennan | H01F 38/18 | 336/117 |
| 4,553,123 | A * | 11/1985 | Tamada | H01F 27/292 | 336/192 |
| 2012/0319812 | A1 * | 12/2012 | Shang | H01F 27/306 | 336/233 |
| 2015/0179323 | A1 | 6/2015 | Uemoto | | |

FOREIGN PATENT DOCUMENTS

| | | | | |
|---|---|---|---|---|
| EP | 2879139 | A1 | | 6/2015 |
| JP | 54-95864 | U | | 7/1979 |
| JP | 55-47178 | U | | 3/1980 |
| JP | 57-10727 | U | | 1/1982 |
| JP | 2000-260623 | A | | 9/2000 |
| JP | 2005086060 | A | * | 3/2005 |
| JP | 2007-096181 | A | | 4/2007 |
| JP | 4763609 | B2 | | 8/2011 |
| JP | 2014-027050 | A | | 2/2014 |
| KR | 10-2015-0038234 | A | | 4/2015 |
| WO | 2014/017512 | A1 | | 1/2014 |

OTHER PUBLICATIONS

English Claims for JP 4763609 B2 dated Aug. 31, 2011.
English Claims for JP 57-10727 U dated Jan. 20, 1982.
English Claims for JP 54-95864 U dated Jul. 6, 1979.
English Abstract for JP 2014-027050 A dated Feb. 6, 2014.
English Abstract for CN 104488042 A dated Apr. 1, 2015.
English Abstract for KR 10-2015-0038234 A dated Apr. 8, 2015.
English Abstract for JP 2007-096181 A dated Apr. 12, 2007.
English Abstract for CN 1941227 A dated Apr. 4, 2007.
English Claims for JP 55-47178 U dated Mar. 27, 1980.
English Machine Translation for JP 2000-260623 A dated Sep. 22, 2000.

* cited by examiner (a)

(b)

(a)

(b)

MAGNETIC ELEMENT

TECHNICAL FIELD

The present invention relates to a magnetic element formed by winding a coil around a magnetic body and used in an electrical device or an electronic device such as an inductor, a transformer, an antenna (a bar antenna), a choke coil, a filter, and a sensor. In particular, the present invention relates to a pot-shaped inductor in which a coil is surrounded by a magnetic body.

BACKGROUND ART

In recent years, along with the progress of miniaturization, increase of frequency and increase of electric current of an electric device and an electronic device, a magnetic body is required to be dealt with similarly. In the current mainstream ferrite materials as a magnetic body, the material properties themselves are approaching the limit, and thus a new magnetic body material is being required. For example, the ferrite materials are replaced with compression molded magnetic materials such as Sendust and amorphous metal, or amorphous foil strip. However, the molding performance of the compression molded magnetic material described above is inferior, and the mechanical strength after baking is low. Further, the production cost of the amorphous foil strip is high due to winding, cutting and formation of gaps. Therefore, the practical application of these magnetic materials is delayed.

In Patent Document 1, it is proposed to provide a method for producing small-sized and inexpensive magnetic core parts having various shapes and characteristics by using a magnetic powder having poor molding performance. Patent Document 1 proposes a method for producing a core part having predetermined magnetic characteristics by injection molding, the method including coating a magnetic powder contained in a resin composition used in the injection molding with an insulation material, and insert-molding either of a compression molded magnetic body and a pressurized powder magnet-molded body in the resin composition, wherein the compression molded magnetic body or the pressurized powder magnet-molded body contains a binder having a melting point lower than the injection molding temperature (see Patent Document 1).

As shapes of the magnetic body which forms the magnetic element, a troidal-shaped magnetic body, a magnetic body having a shape combining an E-shaped magnetic body and an I-shaped magnetic body, a magnetic body having a shape combining U-shaped magnetic bodies, a pot-shaped magnetic body, and a drum-shaped magnetic body are often adopted.

Among the shapes of the magnetic body, in the E-shaped magnetic body, a characteristic as the magnetic element can be adjusted easily due to its easiness of winding, a gap, or the like. While, in the magnetic element using the pot-shaped magnetic body, further miniaturization thereof is possible and excellent silent performance can be obtained because a coil, which is a noise source, is arranged in the magnetic body. Further, a surface of an inductor as the magnetic element is covered by the magnetic body in a pot-shaped inductor, and thereby leakage of magnetic flux to an outside of the inductor can be reduced. The pot-shaped inductor is formed of a magnetic body of soft magnetic material, and a coil, and a bobbin and an insulation case are further used as needed.

PRIOR ART DOCUMENT

Patent Document

Patent Document 1: JP 4763609 B

SUMMERY OF THE INVENTION

Problems to be Solved by the Invention

In the magnetic element, it is required to reduce the leakage of the magnetic flux or to make a size of the magnetic element small. For example, in a pot-shaped inductor which forms a closed magnetic path, the leakage of the magnetic flux can be reduced and the size thereof can be made small as described above, compared to a drum-shaped core which forms an opened magnetic path. This is because the pot-shaped inductor forms a magnetic path to cover the coil and a wall thickness of the magnetic body arranged at an outer diameter side of the coil is set to be thinner than a radius of the magnetic body arranged at an inner diameter side of the coil. In Patent Document 1, various shapes of the magnetic body can be obtained, and therefore the magnetic body can be formed to cover the coil.

In the pot-shaped inductor, the coil, which is one of main heat generating sources, is included in the inductor, and therefore cooling for decreasing a heat generating temperature of the coil is important compared to an inductor using an E-shaped magnetic body. Thus, in the pot-shaped inductor, for example in order to improve heat dissipating performance of the included coil, a gap between the coil and the magnetic body, namely a core inner space, may be sealed by a sealing resin or the like.

However, when the sealing resin is filled from a coil terminal drawing port formed on an outer circumference surface of the magnetic body in order to improve electric insulation performance or the heat dissipating performance of the coil after the coil is housed in the magnetic body, workability of filling operation of the sealing resin might be deteriorated.

Further, in the pot-shaped inductor which forms the closed magnetic path as described above, in a case in which the resin is not filled in the core inner space, cooling performance is inferior because a flow of air is not generated around the coil.

An object of the present invention is, in order to solve such a problem, to provide a magnetic element such as a pot-shape inductor in which a coil is covered by a magnetic body, having excellent cooling performance and being capable of suppressing heat generation. Further, another object of the present invention is to provide a magnetic element having excellent workability of filling operation of a sealing resin in a configuration in which the sealing resin is filled.

Means for Solving the Problem

A magnetic element according to the present invention includes a coil formed by winding a winding wire, and a magnetic body in which the coil is arranged and which transmits magnetic flux generated by the coil. The magnetic body includes an air-cooling portion for air-cooling the magnetic element, on a magnetic body outer diameter portion which covers an outer diameter side of the coil. The air-cooling portion has a hole structure penetrating the magnetic body outer diameter portion or an uneven structure formed on an outer circumference portion of the magnetic body outer diameter portion.

The magnetic body is formed by joining a compression molded magnetic body arranged at an inner diameter side of the coil and an injection molded magnetic body arranged at an outer diameter side of the coil. The compression molded magnetic body is exposed to a surface of the magnetic body. The magnetic body outer diameter portion is formed by the injection molded magnetic body. Further, the injection molded magnetic body is formed by a joint body mutually joining two magnetic bodies divided in an axial direction of the coil.

The air-cooling portion has the hole structure, and the divided two magnetic bodies include a concave shape and a convex shape complementary to each other, which are fitted with each other when the divided two magnetic bodies are joined, at respective inner diameter sides of the magnetic body outer diameter portions. Further, the air-cooling portion has the hole structure, and the divided two magnetic bodies include flange portions on respective outer circumference portions of the magnetic body outer diameter portions at joining positions of the divided two magnetic bodies.

The air-cooling portion has the hole structure, and a terminal of the coil is drawn to an outside through the hole structure.

The coil is sealed by a sealing resin, and the magnetic body includes a flow control path, which controls a flow of the resin in filling the sealing resin, on a surface facing the coil.

The flow control path is formed by an uneven portion along at least one of an axial direction and a circumferential direction of the coil. Further, the uneven portion is formed in a triangular shape in a cross section.

An air storage portion is formed in a part of the flow control path.

Effects of the Invention

The magnetic element according to the present invention is formed by arranging the coil in the magnetic body, and the magnetic element includes the air-cooling portion for air-cooling the magnetic element, on the magnetic body outer diameter portion which covers the outer diameter side of the coil. Since the air cooling portion has the hole structure (a slit or an aperture) penetrating the magnetic body outer diameter portion, a flow of air which communicates an inside of the magnetic element to an outside of the magnetic element can be generated, and therefore cooling performance can be improved. On the other hand, since the air-cooling portion has the uneven structure formed on the outer circumference portion of the magnetic body outer diameter portion, cooling performance of the outer circumference portion can be improved because a surface area of the outer circumference portion is increased or the outer circumference portion is arranged along a flow of surrounding air. As a result of these, heat generation can be suppressed, and a size of an inductor or the like as the magnetic element can be made small.

The magnetic body is formed by joining the compression molded magnetic body arranged at the inner diameter side of the coil and the injection molded magnetic body arranged at the outer diameter side of the coil, and the compression molded magnetic body is exposed to a surface of the magnetic body, and the magnetic body outer diameter portion is formed by the injection molded magnetic body, and thereby heat transfer performance of a portion at the inner diameter side of the coil as a part in which heat generation is large due to iron loss or a part in which heat dissipating performance is inferior, can be improved.

Since the injection molded magnetic body is formed by the joint body mutually joining the two magnetic bodies divided in the axial direction of the coil, after the magnetic bodies (divided bodies) are formed, the coil is inserted and then the magnetic element is produced by joining the divided bodies. Thus, a producing equipment cost can be decreased, productivity can be improved, and a producing cost can be decreased compared to a magnetic element formed by means of injection molding.

The air-cooling portion has the hole structure, and since (1) the divided two magnetic bodies include the concave shape and the convex shape complementary to each other, which are fitted with each other when the divided two magnetic bodies are joined, at respective inner diameter sides of the magnetic body outer diameter portions, or since (2) the divided two magnetic bodies include the flange portions on respective outer circumference portions of the magnetic body outer diameter portions at the joining positions of the divided two magnetic bodies, the magnetic body outer diameter portion can be prevented from opening toward an outer diameter direction caused by the hole structure such as a slit or an aperture. Further, for example, as the concave shape and the convex shape in the feature (1) described above, by forming the concave shape and the convex shape mutually fitted after rotated by 180 degrees around any axis on an end surface at a coil insertion side, positioning of the divided two magnetic bodies in joining can be achieved.

The air-cooling portion has the hole structure, and since the terminal of the coil is drawn to an outside through the hole structure, the hole structure such as the slit and the aperture is also served as a drawing port of the terminal of the coil, and thereby a degree of freedom of a layout of the coil is enhanced. That is, the terminal of the coil can be drawn from any hole, and thereby a specific drawing port is not necessary.

In another aspect of the present invention in which the coil is sealed by the sealing rein, the magnetic body includes the flow control path, which controls the flow of the resin in filling the sealing resin, on the surface facing the coil, and thereby resin flowability in filling the sealing resin is improved. As a result, workability of the filling operation is improved. Further, a void generated in the sealing resin in the filling operation is reduced, and thereby heat dissipating performance and electric insulation performance of the magnetic element can be improved.

Further, the flow control path is formed by the uneven portion along at least one of the axial direction and the circumferential direction of the coil, and therefore a depth of the uneven portion or a cross section of a groove or the like can be made large, and thereby the sealing resin can be filled quickly. Further, by forming the uneven portion as a groove having a triangular shape in a cross section, a gap formed between the groove and a surface of the coil becomes narrow, and therefore the resin sealing is easily performed into details by a drawing effect due to surface tension of the sealing material.

Further, the air storage portion is formed in a part of the flow control path, and thereby a void apt to be generated in filling the sealing resin can be suppressed to be dispersed in the sealing resin. As a result, the heat dissipating performance of the coil included in the pot-shape inductor can be improved.

MODE FOR CARRYING OUT THE INVENTION

A magnetic element according to the present invention is suitable for a pot-shaped magnetic element (an inductor) in which a coil is arranged in a magnetic body. Generally, a pot-shaped inductor has advantages that (1) leakage of magnetic flux can be reduced because a magnetic path is arranged to cover the coil and (2) a shape of the magnetic body can be made small because a wall thickness of the magnetic body at an outer diameter side of the coil is thinner than a radius of the magnetic body at an inner diameter side of the coil. However, cooling performance of the pot-shaped inductor might not be sufficient as described above. Therefore, in the present invention, the cooling performance is improved by arranging an air-cooling portion for air-cooling the magnetic element, on a magnetic body outer diameter portion which covers an outer diameter side of the coil.

Further, in the increase of frequency and the increase of electric current of an electric device and an electronic device, the magnetic element using the current mainstream ferrite material obtained by a compression molding method has excellent magnetic permeability and an inductance value can be obtained easily, however frequency characteristics and current superimposition characteristics are inferior. On the other hand, the magnetic element using the injection molded magnetic material including amorphous material has excellent frequency characteristics and current superimposition characteristics, however the magnetic permeability thereof is inferior. Further, in the magnetic element for large current, heat generation due to iron loss cannot be ignored in addition to heat generation due to copper loss. Thus, in a preferred embodiment of the present invention, a structure in which heat generation is suppressed and which has excellent heat dissipating performance can be achieved by adopting a pot-shaped hybrid inductor including a magnetic body at an inner diameter side of a coil where heat is easily generated or heat is hardly dissipated being formed by a compression molded magnetic body (a part thereof is exposed to an outside) having excellent heat transfer performance, and a magnetic body at outer diameter side of the coil being formed by an injection molded magnetic body in which the air-cooling portion is arranged.

Figure 1:
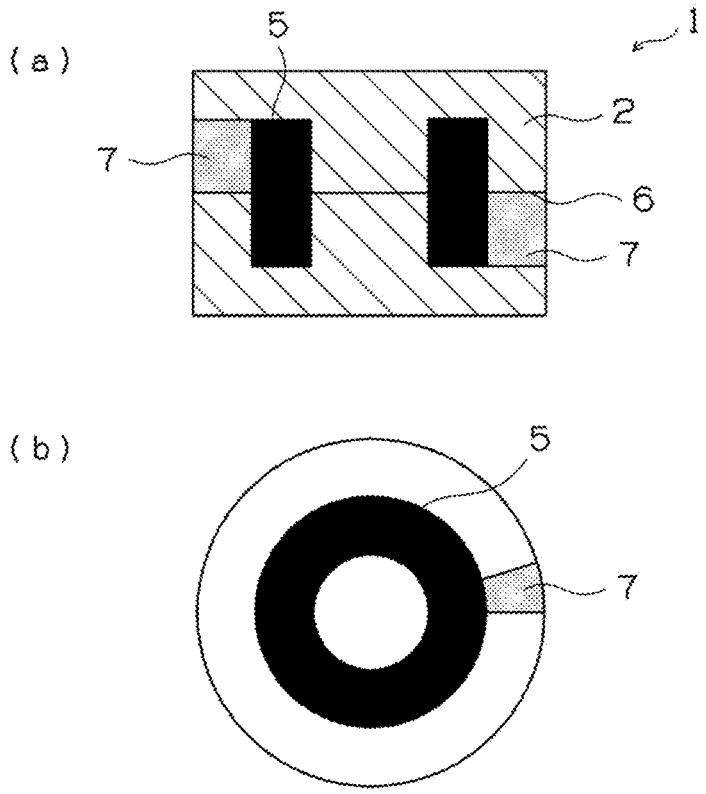
FIGS. 1(*a*) and 1(*b*) illustrate one example of a pot-shaped inductor.
Figure 3:
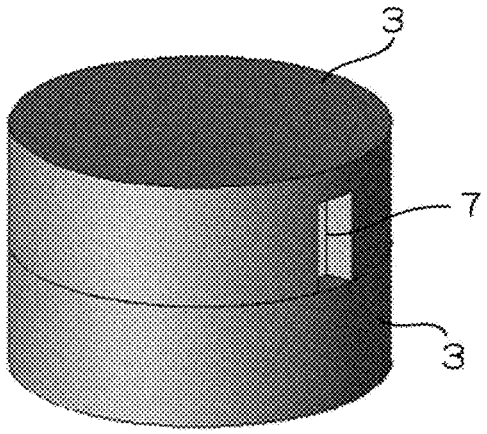
FIGS. 3(*a*) and 3(*b*) illustrate a magnetic body in the inductor in FIGS. 1(*a*) and 1(*b*).
Figure 3:
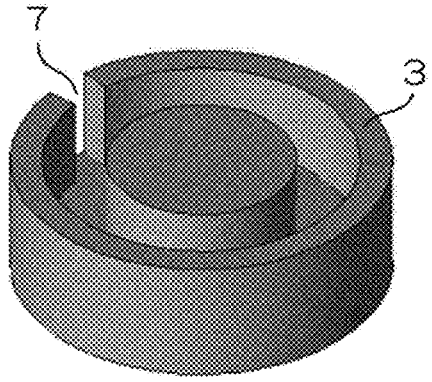

FIGS. 1(*a*) and 1(*b*) and FIGS. 3(*a*) and 3(*b*) illustrate one example of a magnetic element according to the present invention. FIG. 1(*a*) is an axial cross-sectional view of a pot-shaped inductor, and FIG. 1(*b*) is a plane view of a lower half part of the inductor divided at a center portion in an axial direction. Further, FIG. 3(*a*) is a perspective view of a magnetic body, and FIG. 3(*b*) is a perspective view of a lower half part of the magnetic body divided at a center portion in an axial direction.

As shown in FIG. 1(*a*) and FIG. 1(*b*), an inductor 1 is provided with a coil 5 formed by winding a winding wire, and a magnetic body 2 in which the coil 5 is arranged and which transmits magnetic flux generated by the coil 5. The magnetic body 2 is arranged to cover the whole of the coil 5. The magnetic body 2 is formed of, for example, an injection molded magnetic body described below. Further, the magnetic body 2 is divided into two bodies by a middle line 6 in a length of the magnetic body 2 in an axial direction. The magnetic body 6 is formed by a joint body joining the divided bodies (see FIGS. 3(*a*) and 3(*b*)). The divided two bodies of the magnetic body are the same shape, and therefore the divided two bodies can be produced by one molding die.

In the present invention, the pot-shaped inductor 1 having such a structure is provided with a slit 7 as a hole structure which arranged on an outer diameter portion of the magnetic body 2 so as to penetrate from an outer circumference surface circumference of the outer diameter portion to the coil 5. The coil 5 is inserted into the magnetic body 2 in a state in which the magnetic body 2 is divided by the middle line 6. A gap between the coil 5 and the magnetic body 2 is not filled by a resin or the like. A flow of air which communicates an inside of the inductor (a space in which the coil 5 is arranged) with an outside can be generated by the slit 7, and thereby cooling performance can be improved. For example, the flow of the air in which air introduced from the (upper side) slit 7 at a left side in FIG. 1(*a*) is passed around the coil 5 and discharged from the (lower side) slit 7 at a right side in FIG. 1(*a*), can be generated.

Figure 2:
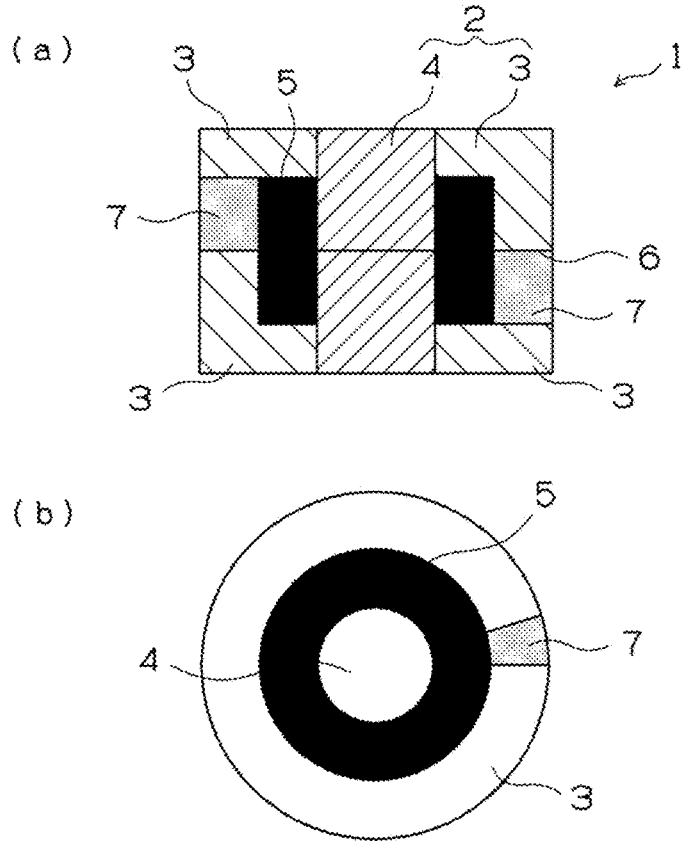
FIGS. 2(*a*) and 2(*b*) illustrate another example of the pot-shaped inductor.
Figure 4:
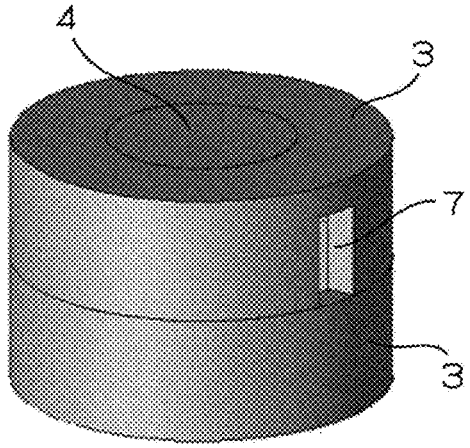
FIGS. 4(*a*) and 4(*b*) illustrate a magnetic body in the inductor in FIGS. 2(*a*) and 2(*b*).
Figure 4:
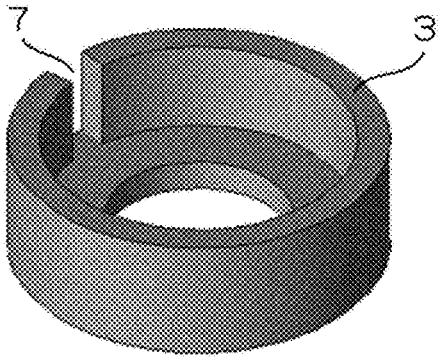

FIGS. 2(*a*) and 2(*b*) and FIGS. 4(*a*) and 4(*b*) illustrate another example of a magnetic element according to the present invention. FIG. 2(*a*) is an axial cross-sectional view of a pot-shaped hybrid inductor, and FIG. 2(*b*) is a plane view of a lower half part of the inductor divided at a center portion in an axial direction. Further, FIG. 4(*a*) is a perspective view of a magnetic body, and FIG. 4(*b*) is a perspective view of a lower half part of the magnetic body divided at a center portion in an axial direction.

As shown in FIG. 2(*a*) and FIG. 2(*b*), an inductor 1 is, similar to that shown in FIGS. 1(*a*) and 1(*b*), provided with a coil 5 formed by winding a winding wire, and a magnetic body 2 in which the coil 5 is arranged and which transmits magnetic flux generated by the coil 5. In this configuration, the magnetic body 2 is formed by joining a compression molded magnetic body 4 arranged at an inner diameter side of the coil 5 and an injection molded magnetic body 3 arranged at an outer diameter side of the coil 5. In the magnetic body 2, both of the compression molded magnetic body 4 and the injection molded magnetic body 3 are respectively divided into two bodies by a middle line 6 in a length of each magnetic body in an axial direction. The compression molded magnetic body 4 and the injection molded magnetic body 3 are formed by joint bodies joining the divided bodies, respectively. Here, only the injection molded magnetic body 3 may be formed by the joint body joining the divided two bodies divided by the middle line 6 in the length of the magnetic body in the axial direction (see FIGS. 4(*a*) and 4(*b*)).

In this configuration, a slit 7 having the same structure as that shown in FIGS. 1(*a*) and 1(*b*) is formed on an outer diameter portion (the injection molded magnetic body 3) of the magnetic body 2, and thereby a similar effect can be obtained. Further, an end surface of the compression molded magnetic body 2 is exposed to a surface (center portions of an upper surface and a bottom surface) of the inductor 1. For example, by contacting the exposed end surface with a cooling surface of a substrate or the like, heat transmission at the inner diameter side of the coil in which heat dissipation is difficult can be promoted.

Figure 5:
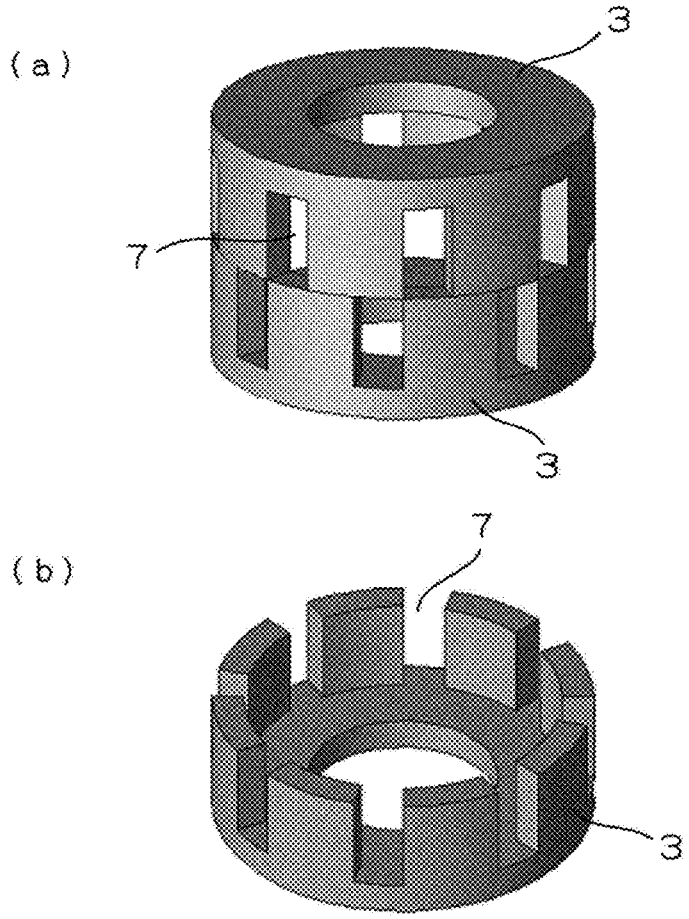
FIGS. 5(*a*) and 5(*b*) illustrate other example of a magnetic body outer diameter portion (having a plurality of slits).
Figure 8:
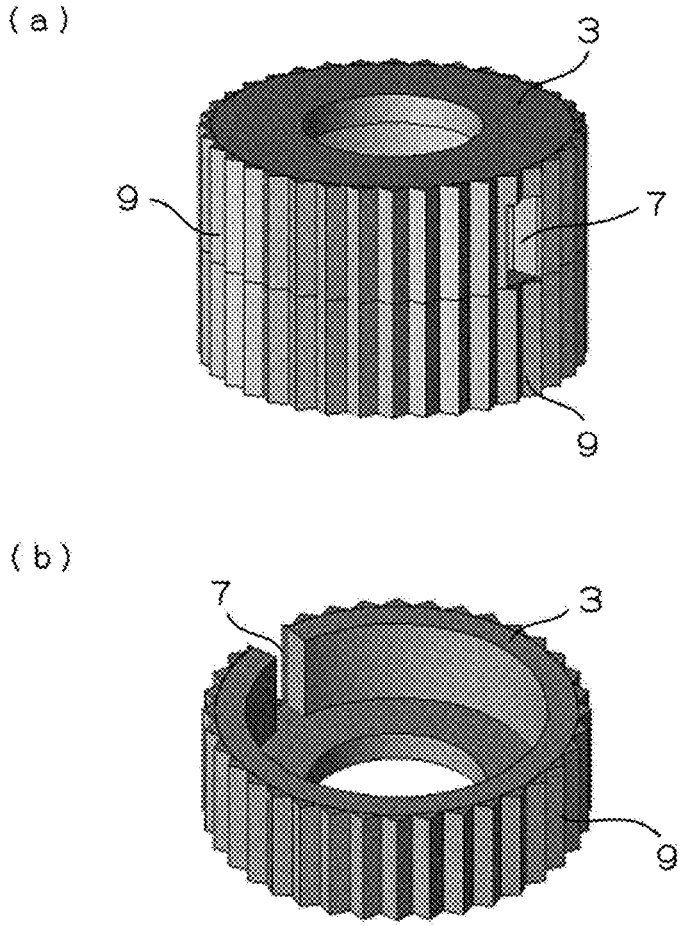
FIGS. 8(*a*) and 8(*b*) illustrate other example of the magnetic body outer diameter portion (having an uneven structure on an outer circumference portion).

FIGS. 5(*a*) and 5(*b*) through FIGS. 8(*a*) and 8(*b*) illustrate other examples of the magnetic body outer diameter portion (the injection molded magnetic body or the like) of the magnetic element according to the present invention. FIGS. 5(*a*) through 8(*a*) are perspective views of the injection molded magnetic body served as the magnetic body outer diameter portion, and FIGS. 5(*b*) through 8(*b*) are perspective views of a lower half part of the injection molded magnetic body divided at a center portion in an axial direction.

An injection molded magnetic body 3 shown in FIGS. 5(*a*) and 5(*b*) is provided with slits 7 at two points or more (eight points in the figure) at the same interval in a circumferential direction. With these slits 7, the cooling effect can be improved as described above. Further, by forming a width of the slit 7 to be narrower than a width of a column portion between the slits 7 adjacent to each other, a continuous magnetic path can be formed and positioning in an upper-lower direction can be performed by using a core instead of a coil. Thus, a characteristic error due to deviation of a length of the magnetic path can be suppressed.

Figure 6:
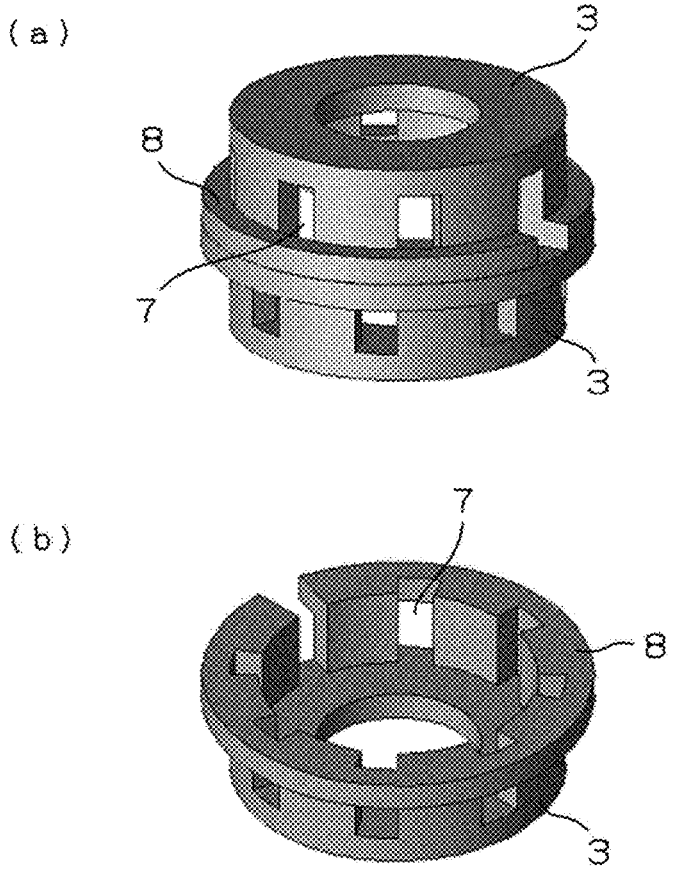
FIGS. 6(*a*) and 6(*b*) illustrate other example of the magnetic body outer diameter portion (having a plurality of slits and a flange).

An injection molded magnetic body 3 shown in FIGS. 6(*a*) and 6(*b*) is provided with, similar to the configuration shown in FIGS. 5(*a*) and 5(*b*), slits 7 at eight points at the same interval in a circumferential direction. In this configuration, a flange 8 is formed on an outer circumference portion at a position of a joint portion (an end surface at a coil insertion side) of the divided magnetic bodies 3. The magnetic body 3 is reinforced by the flange 8, and thereby opening of the injection molded magnetic body toward an outer diameter direction caused by the slit arranged in the circumferential direction can be suppressed. Further, notches for drawing a terminal of a coil may be arranged at several points as needed.

Figure 7:
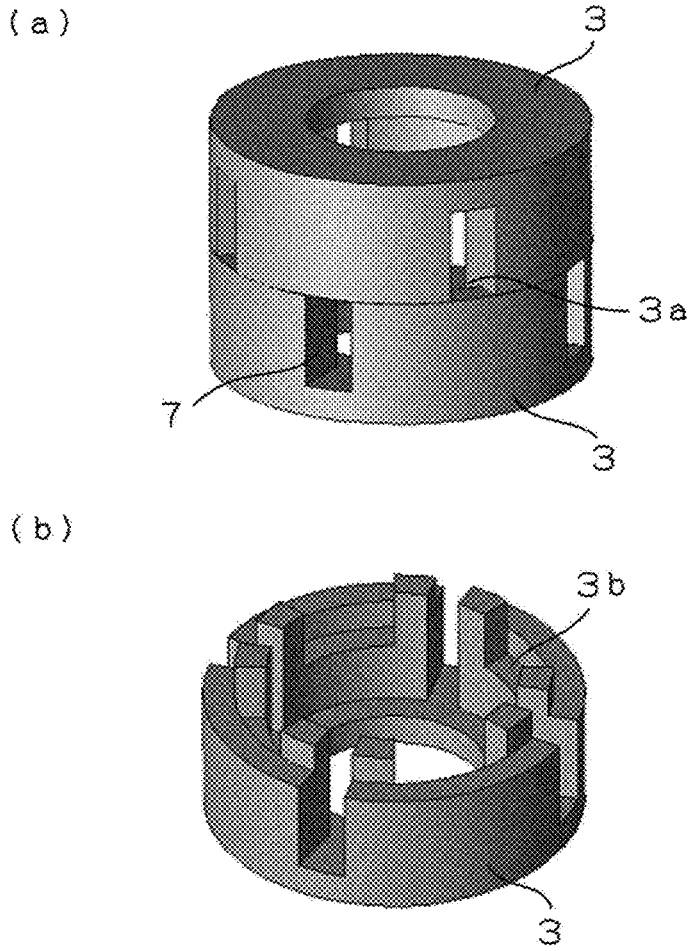
FIGS. 7(*a*) and 7(*b*) illustrate other example of the magnetic body outer diameter portion (having a concave shape and a convex shape complementary to each other).

An injection molded magnetic body 3 shown in FIGS. 7(*a*) and 7(*b*) is provided with slits 7 at four points at the same interval in a circumferential direction. In this configuration, a concave shape 3*b* and a convex shape 3*a* complementary to each other, which are fitted with each other when divided bodies of the injection molded magnetic body 3 are joined, are formed at inner diameter sides of the divided bodies, respectively. The concave shape and the convex shape are formed on an inner diameter portions at a position of a joint portion (an end surface at a coil insertion side) of the divided two magnetic bodies 3. With this, positioning of the divided bodies in the circumferential direction can be performed when contacting the divided bodies with each other. Further, by forming slit 7 at a portion corresponding to the convex shape at the inner diameter side, when the convex shape and the concave shape are fitted with each other, the continuous magnetic body is arranged at the outer diameter side, and thereby opening of the injection molded magnetic body toward an outer diameter direction caused by arranging the slit can be suppressed.

An injection molded magnetic body 3 shown in FIGS. 8(*a*) and 8(*b*) is provided with a slit 7 at one point in a circumferential direction and an uneven structure 9 on an outer diameter portion. By forming an uneven surface on the outer diameter portion along a flow of air, cooling performance of the outer diameter portion can be improved. An uneven shape shown in the figures is preferable in a case in which the inductor is arranged such that an axial direction of the inductor is matched with a vertical direction. Further, the uneven shape is not limited to a configuration shown in the figures as long as it leads improvement of the cooling performance.

As described above, the pot-shaped inductors are described as the magnetic element according to the present invention with reference to FIGS. 1(*a*) and 1(*b*) through FIGS. 8(*a*) and 8(*b*), however the configuration of the magnetic element according to present invention is not limited to these. Further, in each configuration shown in FIGS. 1(*a*) and 1(*b*) through FIGS. 8(*a*) and 8(*b*), the slit provided as the hole structure is used as a drawing port of the terminal of the coil, and thereby a degree of freedom of a layout of the coil is enhanced.

Other configurations according to the present invention in which a coil is sealed by a sealing resin are described. A pot-shaped magnetic element (an inductor) is provided with a core magnetic body (the compression molded magnetic body described above or the like) arranged at an inner diameter portion of a coil, and an outer circumference magnetic body (the injection molded magnetic body described above or the like) which covers the coil. A closed magnetic path structure which confines magnetic flux generated by the coil in the core magnetic body and the outer circumference magnetic body is formed. In this configuration, in order to improve electric insulation performance or heat dissipating performance of the coil, the coil is sealed by the sealing resin. The filling operation of the sealing resin might take much time in accordance with flowability of the resin to be sealed, compatibility of the resin with an insulation film of an enamel wire which forms the magnetic body or the coil, or a clearance between the magnetic body and the coil, and thereby workability of the sealing operation of the resin is deteriorated. Further, operation which removes a void generated in filling might take much time, and thereby the workability of the sealing operation of the resin is also deteriorated. However, by forming a flow control path which controls a flow of the resin in filling the sealing resin, the workability of the sealing operation of the resin can be improved. This configuration according to the present invention is derived from such knowledge.

Figure 9:
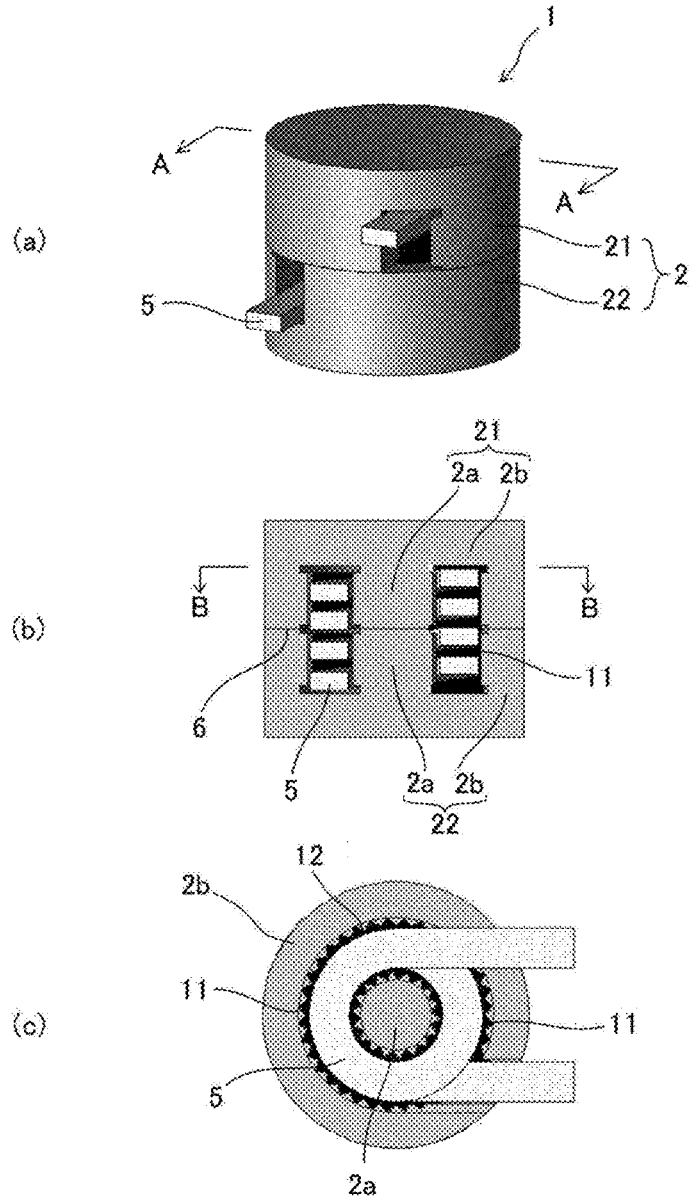
FIGS. 9(*a*) through 9(*c*) illustrate one example of the pot-shaped inductor in which a sealing resin is filled.

FIGS. 9(*a*) through 9(*c*) illustrate one example of a magnetic element according to this configuration. FIG. 9(*a*) is a perspective view of a pot-shaped inductor in which a sealing resin is filled, FIG. 9(*b*) is a cross-sectional view taken along line A-A, and FIG. 9(*c*) is a cross-sectional view taken along line B-B. As shown in FIGS. 9(*a*) through 9(*c*), an inductor 1 is provided with a coil 5 formed by winding a winding wire, and a magnetic body 2 in which the coil 5 is arranged and which transmits magnetic flux generated by the coil 5. The magnetic body 2 is arranged to cover the whole of the coil 5. The coil 5 is sealed by a sealing resin 11. The magnetic body 2 is formed by a core magnetic body 2*a* around which the winding wire is wound, and an outer circumference magnetic body 2*b* which covers an outer circumference of the coil 5. As shown in FIGS. 9(*a*) through 9(*c*), the core magnetic body 2*a* and the outer circumference magnetic body 2*b* may be formed as a single magnetic body, and in such a case, a part at the inner diameter side of the coil is the core magnetic body 2*a* and a part at the outer diameter side of the coil and at an upper side and a lower side of the coil is the outer circumference magnetic body 2*b*.

A flow control path 12 which controls a flow of the resin in filling the sealing resin 11, is formed on each surface of the core magnetic body 2*a* and the outer circumference magnetic body 2*b* facing the coil 5. The flow control path 12 may be formed on both of the surfaces of the core magnetic body 2*a* and the outer circumference magnetic body 2*b* facing the coil 5 or may be formed of one of the surfaces of the core magnetic body 2*a* and the outer circumference magnetic body 2*b* facing the coil 5. The magnetic body 2 is divided into two bodies of an upper magnetic body 21 and a lower magnetic body 22 by a middle line 6 in a length of the magnetic body 2 in an axial direction in the figures, and thereby the magnetic body 2 is formed by a joint body of the divided bodies. The divided two magnetic bodies of the magnetic body 21 and the magnetic body 22 have the same shape to each other, and therefore the two magnetic bodies can be produced by a single molding die.

Figure 10:
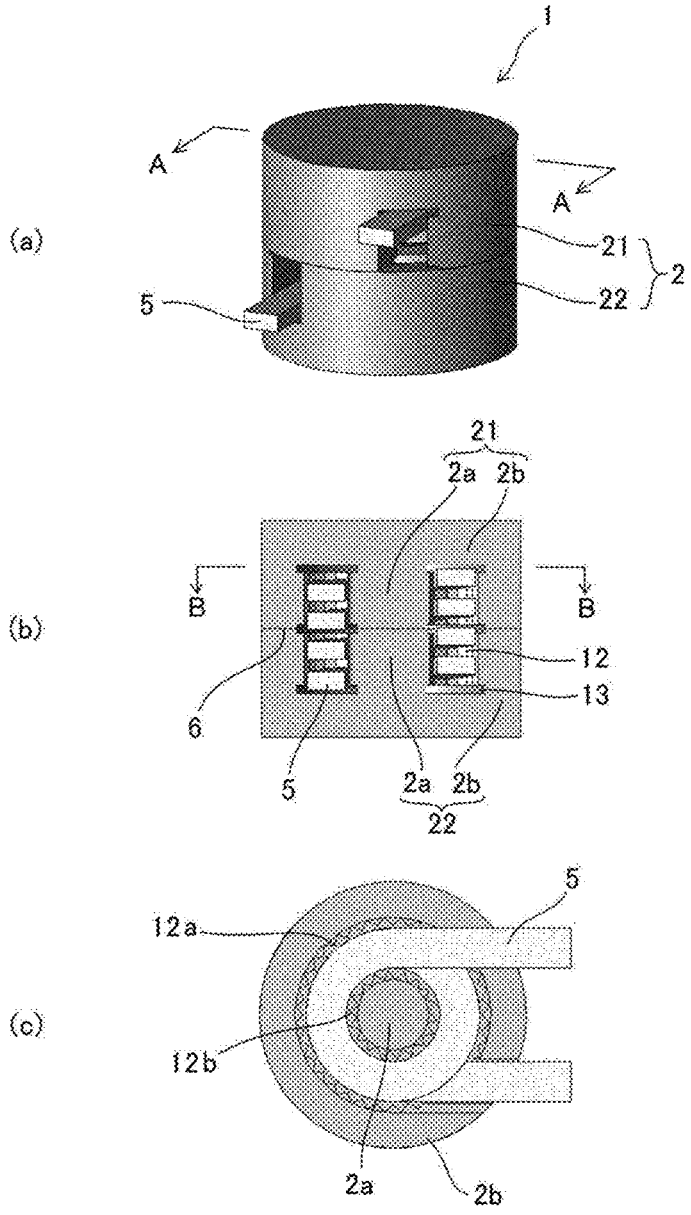
FIGS. 10(*a*) through 10(*c*) illustrate the example of the pot-shaped inductor before the sealing resin is filled.

FIGS. 10(*a*) through 10(*c*) illustrate a sectional shape of the pod-shaped inductor before the sealing resin 11 is filled. FIG. 10(*a*) is a perspective view of the pod-shaped inductor before the sealing resin is filled, FIG. 10(*b*) is a cross-sectional view taken along line A-A, and FIG. 10(*c*) is a sectional view taken along line B-B. In the magnetic body 2, a flow control path 12*b* is formed on a surface of the core magnetic body 2*a* facing the coil 5 and a flow control path 12*a* is formed on a surface of the outer diameter magnetic body 2*b* facing the coil 5. Each of the flow control paths 12*a*, 12*b* is formed as the flow control path 12 which controls the flow of the resin in filling the sealing resin. Further, a part of the flow control path 12 is served as an air storage portion 13. A part of the flow control path 12 is served as the air storage portion 13, and thereby a void can be suppressed to be dispersed in the sealing resin.

Figure 11:
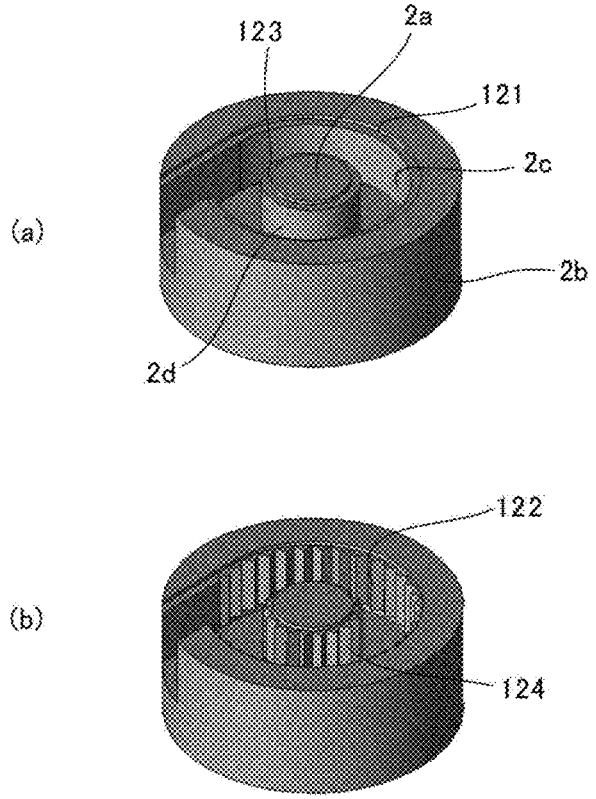
FIGS. 11(*a*) and 11(*b*) illustrate a pot-shaped magnetic body in which a flow control path and an air storage portion are formed.

FIGS. 11(*a*) and 11(*b*) illustrate perspective views of the magnetic body 2 in which the flow control path and the air storage portion are formed. FIG. 11(*a*) illustrates an example in which a circumference groove is formed near a center of the pot-shaped magnetic body, and FIG. 11(*b*) illustrates an example in which an axial groove is formed in addition to the circumference groove.

Examples of the flow control path and the air storage portion include the following configurations (1) through (6).

(1) A groove 121 formed on a surface 2*c* of the outer circumference magnetic body 2*b* at an inner diameter side to be contacted with the coil and formed on a center portion the outer circumference magnetic body 2*b* in an axial direction and an upper portion and a lower portion of the outer circumference magnetic body 2*b* in a circumferential direction.

(2) A groove 122 formed on a surface 2*c* of the outer circumference magnetic body 2*b* at the inner diameter side to be contacted with the coil and formed in the axial direction of the outer circumference magnetic body 2*b*.

(3) An air storage portion (not shown) formed on a surface 2*c* of the outer circumference magnetic body 2*b* at the inner diameter side to be contacted with the coil and formed in a part in the circumferential direction of the outer circumference magnetic body 2*b*.

(4) A groove 123 formed on a surface 2*d* of the core magnetic body 2*a* at an outer diameter side to be contacted with the coil and formed on a center portion the core magnetic body 2*a* in an axial direction and an upper portion and a lower portion of the core magnetic body 2*a* in a circumferential direction.

(5) A groove 124 formed on a surface 2*d* of the core magnetic body 2*a* at the outer diameter side to be contacted with the coil and formed in the axial direction of the core magnetic body 2*a*.

(6) An air storage portion (not shown) formed on a surface 2*d* of the core magnetic body 2*a* at the outer diameter side to be contacted with the coil and formed in a corner part in the circumferential direction of the core magnetic body 2*a*.

A sectional shape of the flow control path 12 in a flow direction in filling the sealing resin is not especially limited as long as it is formed in an uneven shape along the axial direction and/or the circumferential direction of the coil, however it is preferable that the sectional shape is formed in a half circular shape or a triangular shape rather than a rectangular shape. Especially, the groove formed in the triangular shape is preferable because a gap between the groove and the surface of the coil becomes narrow and therefore the resin sealing is facilitated into details by a drawing effect due to surface tension of a sealing material.

A degree of easiness of performing the resin sealing can be controlled by the sectional shape of the flow control path 12 in the flow direction. For example, as a cross section of the groove described above becomes larger, the sealing resin can enter into the groove more quickly. Further, in a case in which the cross section is constant, as a total length of sides of the sectional shape of the groove contacting with the sealing resin becomes longer, the sealing resin can enter into the groove more quickly.

Further, the flow of the resin in filling the sealing resin can be controlled by adjusting a gap between an apex of a protrusion portion of the groove and the coil together with the sectional shape of the groove.

Figure 12:
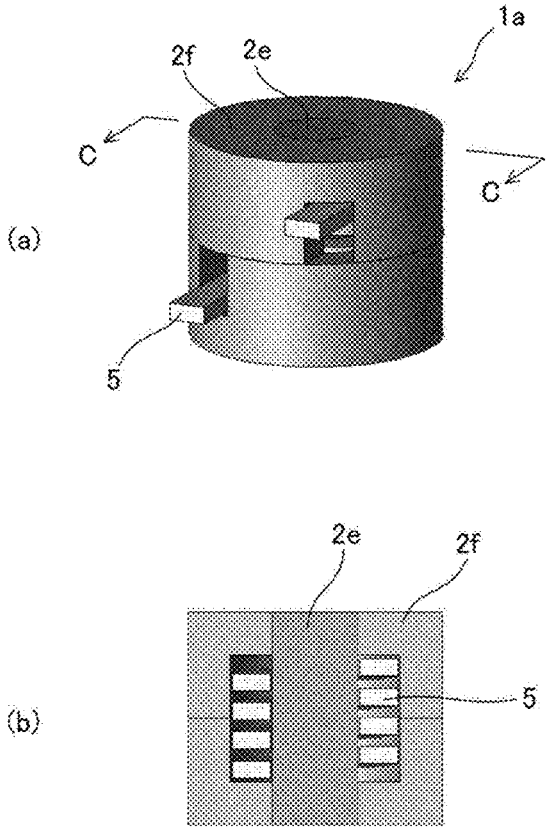
FIGS. 12(*a*) and 12(*b*) illustrate one example of a pot-shaped hybrid inductor.

FIGS. 12(*a*) and 12(*b*) illustrate another example of the magnetic element according to the present invention. FIGS. 12(*a*) and 12(*b*) illustrate an example of the inductor in FIGS. 10(*a*) through 10(*c*) formed as a hybrid inductor, and FIG. 12(*a*) is a perspective view of the hybrid inductor and FIG. 12(*b*) is a cross-sectional view taken along line C-C. In the magnetic element, a flow control path for resin is formed, and a magnetic body 2*e* at an inner diameter side of a coil where heat is easily generated or heat is hardly dissipated is formed by a compression molded magnetic body (a part thereof is exposed to an outside) having excellent heat transfer performance, and a magnetic body 2*f* at outer diameter side of the coil is formed by an injection molded magnetic body, and thereby a hybrid inductor is formed. With this configuration, a structure in which heat generation is suppressed and heat dissipating performance is excellent can be obtained.

The magnetic element according to this configuration is excellent in the heat dissipating performance, the electric insulation performance and the degree of easiness of filling the sealing resin, compared to a configuration in which a flow control path and an air storage portion are not formed. Details thereof are described below.

"Heat Dissipating Performance"

Especially in a conventional product in which the flow control of the sealing resin is not performed, inside air is not discharged because the sealing resin entered from the drawing port of the terminal of the coil is filled in the inductor at random, and therefore the air is apt to be retained as an air bubble. Further, flow speed of fluid such as the sealing material becomes lower near a wall surface. Thus, a void included in the sealing resin is apt to be retained especially in a corner part of the wall surface in the core or a surface of the winding wire. When the air bubble is retained, a contact surface with the sealing resin becomes small, and thereby a heat transfer coefficient is deteriorated and heat dissipation of the coil through the sealing resin is interrupted. In order to avoid this, a part of the flow control path formed at the corner part is set to be the air storage portion, and thereby the deterioration of the heat transfer coefficient of the sealing resin near the coil is avoided.

"Electric Insulation Performance"

In a case in which a large void is generated in the sealing resin between the coil and the core, a thickness of the sealing resin served as an insulation resin cannot be sufficiently ensured, compared to a case in which the void is not generated. Accordingly, dielectric strength is deteriorated and thereby insulation breakdown is caused.

"Degree of Easiness of Filling Sealing Resin"

Priority of filling is set such that the groove 122 or the groove 124 shown in FIGS. 11(*a*) and 11(*b*) is served as a guide for the flow of the sealing resin and air retained inside is reduced. Further, by forming the air storage portion, the air bubble retained inside can be collected in the air storage portion. Thus, filling of the sealing resin is facilitated, and time for vacuuming is shortened in a case in which the vacuuming is necessary, and therefore cost reduction is achieved.

As described above, the pot-shaped inductor in which the coil is sealed by the sealing resin is described with reference to FIGS. 9(*a*) through 9(*c*) to FIGS. 12(*a*) and 12(*b*), however a structure of the flow control path or the like in this configuration according to the present invention is not limited to these. Further, by combining the air-cooling portions described above in the magnetic body outer diameter portion which covers the outer diameter side of the coil, an excellent cooling effect can be obtained.

The compression molded magnetic body which can be used in the present invention is formed of magnetic materials such as iron powder; metal powders; pure iron-based soft magnetic materials such as an iron nitride powder; a Fe—Si—Al alloy (Sendust) powder; a Super Sendust powder; a Ni—Fe alloy (permalloy) powder; a Co—Fe alloy powder; iron group alloy-based soft magnetic material such as a Fe—Si—B-based alloy powder; ferrite-based magnetic material; amorphous-based magnetic material; and microcrystalline material.

Examples of the ferrite-based magnetic material include spinel ferrite having a spinel crystalline structure such as manganese zinc ferrite, nickel zinc ferrite, copper zinc ferrite, and magnetite; hexagonal ferrite such as barium ferrite and strontium ferrite; and garnet ferrite such as yttrium iron garnet. Of these ferrite-based magnetic materials, the spinel ferrite which is a soft magnetic ferrite is preferable because it has a high magnetic permeability and a small eddy current loss in a high frequency domain. Further, examples of the amorphous-based magnetic material include iron-based alloys, cobalt-based alloys, nickel-based alloys, and mixtures of these amorphous alloys.

Examples of oxides forming an insulation film on the surfaces of particles of soft magnetic metal powder to be used as the raw materials described above for the compression molded magnetic body include oxides of insulation metals or semimetals such as $Al_2O_3$, $Y_2O_3$, MgO, and $ZrO_2$; glass; and mixtures of these substances. As methods of forming the insulation film, it is possible to use a powder coating method such as mechanofusion, a wet thin film forming method such as electroless plating and a sol-gel method, and a dry thin film forming method such as sputtering.

The compression molded magnetic body can be manufactured by pressure-molding the material powder described above having the insulation film formed on the surfaces of particles thereof or pressure-molding powder composed of the material powder described above and thermosetting resin such as epoxy resin added thereto to obtain a compressed powder compact and thereafter by firing the compressed powder compact. As the total of the amount of the material powder and that of the thermosetting resin is 100 percentages by mass, it is preferable to set the mixing ratio of the material powder in a range between 96 and 100 percentages by mass. When the mixing ratio of the material powder is less than 96 percentages by mass, the mixing ratio thereof is low. Thus, the material powder has a low magnetic flux density and a low magnetic permeability.

The average diameter of the particles of the material powder is preferably set in a range between 1 and 150 μm and more preferably set in a range between 5 and 100 μm. In a case in which the average diameter of the particles of the material powder is less than 1 μm, the compressibility (a measure showing the hardenability of powder) of the material powder is low in a pressure-molding operation. Consequently the strength of the material for the compression molded magnetic body becomes outstandingly low after the compressed powder compact is fired. In a case in which the average diameter of the particles of the material powder is more than 150 μm, the material powder has a large iron loss in a high frequency domain. Consequently the material powder has a low magnetic characteristic (frequency characteristic).

As a compression molding method, it is possible to use a method of filling the material powder into a molding die and press-molding the material powder at a predetermined pressure to obtain the compressed powder compact. A fired object is obtained by firing the compressed powder compact. In a case in which amorphous alloy powder is used as the material for the compression molded magnetic body, it is necessary to set a firing temperature lower than the crystallization start temperature of the amorphous alloy. In a case in which the powder to which the thermosetting resin has been added is used, it is necessary to set the firing temperature to a temperature range in which the resin hardens.

The injection molded magnetic body which can be used in the present invention is obtained by adding a binding resin to the raw material powder for the compression molded magnetic body described above and by injection-molding the mixture of the binding resin and the raw material powder. It is preferable to adopt the amorphous metal powder as the magnetic powder because the amorphous metal powder allows the injection molding to be easily performed, the configuration of the injection molded magnetic body formed by the injection molding to be easily maintained, and the composite magnetic core to have an excellent magnetic characteristic. As the amorphous metal powder, it is possible to use the iron-based alloys, cobalt-based alloys, nickel-based alloys, and mixtures of these amorphous alloys described above. The insulation film described above is formed on the surfaces of these amorphous metal powders.

As the binding resin, it is possible to use thermoplastic resin which can be injection-molded. Examples of the thermoplastic resin include polyolefin such as polyethylene and polypropylene, polyvinyl alcohol, polyethylene oxide, polyphenylene sulfide (PPS), liquid crystal polymer, polyether ether ketone (PEEK), polyimide, polyetherimide, polyacetal, polyether sulfone, polysulfone, polycarbonate, polyethylene terephthalate, polybutylene terephthalate, polyphenylene oxide, polyphthalamide, polyamide, and mixtures of these thermoplastic resins. Of these thermoplastic resins, the polyphenylene sulfide (PPS) is more preferable than the other thermoplastic resins because the polyphenylene sulfide (PPS) is excellent in its flowability in an injection molding operation when it is mixed with the amorphous metal powder, is capable of coating the surface of the resulting injection-molded body with a layer thereof, and is excellent in its heat resistance.

As the total of the amount of the material powder and that of the thermoplastic resin is 100 percentages by mass, it is preferable to set the mixing ratio of the material powder in a range between 80 and 95 percentages by mass. In a case in which the mixing ratio of the material powder is less than 80 percentages by mass, the material powder is incapable of obtaining the predetermined magnetic characteristic. In a case in which the mixing ratio of the material powder exceeds 95 percentages by mass, the material powder causes the injection molding performance to be inferior.

As the injection molding method, it is possible to use a method of injecting the raw material powder into a molding die consisting of a movable half thereof butted with a fixed half thereof. As the injection molding condition, it is preferable to set the temperature of the resin in a range between 290 and 350° C. and that of the molding die in a range between 100 and 150° C. in the case of the polyphenylene sulfide (PPS), although the injection molding condition is different according to the kind of the thermoplastic resin.

The compression molded magnetic body and the injection molded magnetic body are separately produced by the methods described above respectively and combined with each other. Each shape is set such that the divided magnetic bodies can be assembled easily and are set to be suitable for compression molding and injection molding respectively. For example, in a case in which a tubular magnetic body without a center shaft hole is formed, a tubular shape to be arranged at the inside diameter side of the coil is formed as the compression molded magnetic body by means of compression molding, whereas a part to be arranged at the outside diameter side of the coil is formed as the injection molded magnetic body by means of injection molding. Thereafter by inserting or fitting the compression molded magnetic body having the tubular shape into a hole formed at a center portion of the injection molded magnetic body, the tubular magnetic body is obtained. Or alternatively, after arranging the compression molded magnetic body in a molding die, the injection molded magnetic body is formed by means of insert molding, and thereby the tubular magnetic body can be produced.

Of the compression molded body and the injection molded magnetic body to be combined with each other, at least the injection molded magnetic body is preferably divided into two magnetic bodies in the axial direction into which the coil is inserted. Any dividing method can be used as long as the coil is inserted into the injection molded magnetic body. It is preferable to axially divide the injection molded magnetic body into two halves. By dividing the injection molded magnetic body into the two halves, the number of molding dies can be reduced. In a case in which an adhesive is used to combine the two bodies with each other, it is preferable to use a solventless type epoxy-based adhesive which allows the two bodies to adhere to each other closely.

A preferable combination of the material for the compression molded magnetic body and the material for the injection molded magnetic body is a combination of amorphous or pure iron powder for the compression molded magnetic body and amorphous metal powder and the thermoplastic resin for the injection molded magnetic body. More preferably, Fe—Si—Cr-based amorphous alloy is used as the amorphous metal and the polyphenylene sulfide (PPS) is used as the thermoplastic resin.

In a case in which the coil is sealed by the sealing resin, examples of the sealing resin include an epoxy resin, a phenol resin, and an acryl resin having excellent heat resistance and excellent corrosion resistance. As a curing agent of the epoxy resin, a latent epoxy curing agent, an amine-based curing agent, a polyamide-based curing agent, or an acid anhydride-based curing agent can be used as needed. As the phenol resin, for example, a novolak type phenol resin or a resol type phenol resin can be used as the resin component thereof.

The inductor served as the magnetic element according to the present invention is formed to have an inductor function, for example, by winding a winding wire around the compression molded magnetic body described above to form the coil. The magnetic element is embedded into an electrical device circuit, or an electronic device circuit. As the winding wire, a copper enamel wire can be used. As a kind of the winding wire, a urethane wire (UEW), a formal wire (PVF), polyester wire (PEW), a polyester imide wire (EIW), a polyamideimide wire (AIW), a polyimide wire (PIW), a double coated wire consisting of these wires combined with one another, a self-welding wire, and a litz wire may be adopted. The polyamideimide wire (AIW) and the polyimide wire (PIW) are preferable because these wires are excellent in the heat resistance. A round wire or a rectangular wire in a section may be adopted as the copper enamel wire. Especially, by winding a minor diameter side of the rectangular wire in the section around the compression molded magnetic body with the rectangular wire in contact with the circumference thereof in an overlapped state, a coil having an improved winding density can be obtained. As a coil winding method, a helical winding method can be preferably adopted.

Further, in a case in which the coil is sealed by the sealing resin, it is preferable to apply annealing treatment which heats the coil at a predetermined temperature to the coil after the winding wire is wound on the coil and before the sealing resin is filled. With this, crack or the like can be prevented from being generated on the film in the resin sealing.

The magnetic element according to the present invention can be used in a power source circuit of a vehicle including a motorcycle, an industrial device or a medical device, a filter circuit, a switching circuit or the like, and therefore the magnetic element can be used as, for example, an inductor, a transformer, an antenna, a choke coil, a filter, or the like. Further, the magnetic element can be used as a surface mount component.

INDUSTRIAL APPLICABILITY

A magnetic element according to the present invention has excellent cooling performance and is capable of suppressing heat generation, and in a configuration in which a sealing resin is filled, the magnetic element has excellent workability of filling operation of the sealing resin, and thereby the magnetic element according to the present invention can be preferably used as a magnetic element for various electrical device and electronic device.

REFERENCE SIGNS LIST

1: inductor
2: magnetic body
3: compression molded magnetic body
4: injection molded magnetic body
5: coil
6: middle line
7: slit
8: flange
9: uneven structure
11: sealing resin
12: flow control path
13: air storage portion

The invention claimed is:

1. A magnetic element comprising:
a coil formed by winding a winding wire; and
a magnetic body in which the coil is arranged and which transmits magnetic flux generated by the coil,
wherein:
the magnetic body includes two or more air-cooling portions for air-cooling the magnetic element, on a magnetic body outer diameter portion which covers an outer diameter side of the coil;
each of the air-cooling portions has a hole structure penetrating the magnetic body outer diameter portion:
the magnetic body is formed by joining a compression molded magnetic body arranged at an inner diameter side of the coil and an injection molded magnetic body arranged at an outer diameter side of the coil;
the compression molded magnetic body is exposed to a surface of the magnetic body; and
the magnetic body outer portion is formed by the injection molded magnetic body.

2. The magnetic element according to claim 1, wherein the injection molded magnetic body is formed by a joint body mutually joining two magnetic bodies divided in an axial direction of the coil.

3. The magnetic element according to claim 2, wherein:
the divided two magnetic bodies include a concave shape and a convex shape complementary to each other, which are fitted with each other when the divided two magnetic bodies are joined, at respective inner diameter sides of the magnetic body outer diameter portions.

4. The magnetic element according to claim 2, wherein:
the divided two magnetic bodies include flange portions on respective outer circumference portions of the magnetic body outer diameter portions at joining positions of the divided two magnetic bodies.

5. The magnetic element according to claim 1, wherein:
a terminal of the coil is drawn to an outside through the hole structure.

6. A magnetic element comprising:
a coil formed by winding a winding wire; and
a magnetic body in which the coil is arranged and which transmits magnetic flux generated by the coil,
wherein:
the magnetic body includes an air-cooling portion for air-cooling the magnetic element, on a magnetic body outer diameter portion which covers an outer diameter side of the coil; and
the air-cooling portion has a hole structure penetrating the magnetic body outer diameter portion or an uneven structure formed on an outer circumference portion of the magnetic body outer diameter portion, wherein: the coil is sealed by a sealing resin; and the magnetic body includes a flow control path, which controls a flow of the resin in filling the sealing resin, on a surface facing the coil.

7. The magnetic element according to claim 6, wherein the flow control path is formed by an uneven portion along at least one of an axial direction and a circumferential direction of the coil.

8. The magnetic element according to claim 7, wherein the uneven portion is formed in a triangular shape in a cross section.

9. The magnetic element according to claim 6, wherein an air storage portion is formed in a part of the flow control path.

* * * * *